United States Patent [19]

Blevins et al.

[11] Patent Number: 4,641,407

[45] Date of Patent: Feb. 10, 1987

[54] TOOLING FOR ELASTOMERIC SWAGING MACHINE

[75] Inventors: Gerald G. Blevins, Edmonds; Fred Johnson, Jr.; Frank R. Lentz, both of Seattle; John P. Root, Kingston, all of Wash.

[73] Assignee: The Boeing Company, Seattle, Wash.

[21] Appl. No.: 734,026

[22] Filed: May 14, 1985

[51] Int. Cl.[4] ..... B21D 41/02; B23P 11/00

[52] U.S. Cl. ..... 29/237; 42/402; 42/58; 42/62

[58] Field of Search ..... 72/402, 393, 370, 58, 72/62, 481; 29/237, 282, 523, 252

[56] References Cited

U.S. PATENT DOCUMENTS

| | | | |
|---|---|---|---|
| 1,946,797 | 2/1934 | Kinney . | |
| 1,986,777 | 1/1935 | Patterson | 72/481 |
| 2,291,803 | 8/1942 | Grotnes | 72/402 |
| 2,370,776 | 3/1945 | Carlson | 29/237 |
| 2,377,191 | 5/1945 | Teachout | 72/481 |
| 2,397,608 | 4/1946 | Johnson | 153/28 |
| 2,446,211 | 8/1948 | Clark | 69/13 |
| 2,454,282 | 11/1948 | Johnson | 153/61 |
| 2,703,925 | 3/1955 | Peck | 72/402 |
| 2,704,104 | 3/1955 | Mueller | 72/58 |
| 2,754,577 | 7/1956 | Maxwell | 29/523 |
| 2,799,317 | 7/1957 | Toulmin, Jr. | 153/32 |
| 2,803,126 | 8/1957 | Meyer | 69/10 |
| 2,804,968 | 9/1957 | Elliott et al. | 203/230 |
| 2,953,291 | 9/1960 | Huck | 226/153 |
| 3,152,630 | 10/1964 | Nilsson | 29/523 |
| 3,190,094 | 6/1965 | Kutas | 72/71 |
| 3,269,168 | 8/1966 | Anderson | 72/481 |
| 3,279,234 | 10/1966 | Ames | 72/366 |
| 3,311,971 | 4/1967 | Hicks et al. | 29/523 |
| 3,438,231 | 4/1969 | Petzschke | 72/160 |
| 3,595,047 | 7/1971 | Fanning et al. | 72/58 |
| 3,683,658 | 8/1972 | Roeschlaub | 72/119 |
| 3,967,840 | 7/1976 | McFall | 285/222 |
| 4,043,160 | 8/1977 | Baker et al. | 29/237 |
| 4,071,936 | 2/1978 | Smith | 72/402 |
| 4,398,328 | 8/1983 | Takenaka et al. | 29/126 |
| 4,411,456 | 10/1983 | Martin | 285/39 |
| 4,460,433 | 7/1984 | Boyd | 156/574 |
| 4,472,959 | 9/1984 | Fencl | 72/402 |

FOREIGN PATENT DOCUMENTS

| | | | |
|---|---|---|---|
| 2028199 | 3/1980 | United Kingdom | 29/252 |
| 1594764 | 8/1981 | United Kingdom | 29/237 |

*Primary Examiner*—Daniel C. Crane
*Attorney, Agent, or Firm*—Joan H. Pauly

[57] ABSTRACT

A split die (12) has a removable split die insert (40) to make it adaptable for receiving different types of ferrules. A ferrule (72) and tube (70) to be attached thereto are received into a cavity (42) in insert (40). Tube (70) indexes on a radial shoulder (76) in ferrule (72). A drawbolt (20) with an elastomeric expander (38) thereon is positioned inside tube (70) with its shaft (22) extending outwardly and through an anvil insert (52, 62). The outer end of the expander (38) is prevented from extruding along drawbolt (20) by a split ring (36). The inner end of expander (38) is contained by portions of the anvil insert (52, 62). In one embodiment, shaft (22) extends through a machined bearing surface (56) in insert (52). A boss (54) on insert (52) extends into ferrule (72) and abuts the inner end of expander (38) to contain expander (38). In another embodiment, a plastic sleeve (66) is received into a cavity (64) in anvil insert (62) and provides a bearing engagement with shaft (22) and a sealing engagement with the inner end of expander (38) and adjacent radial end portions of the ferrule (72).

2 Claims, 14 Drawing Figures

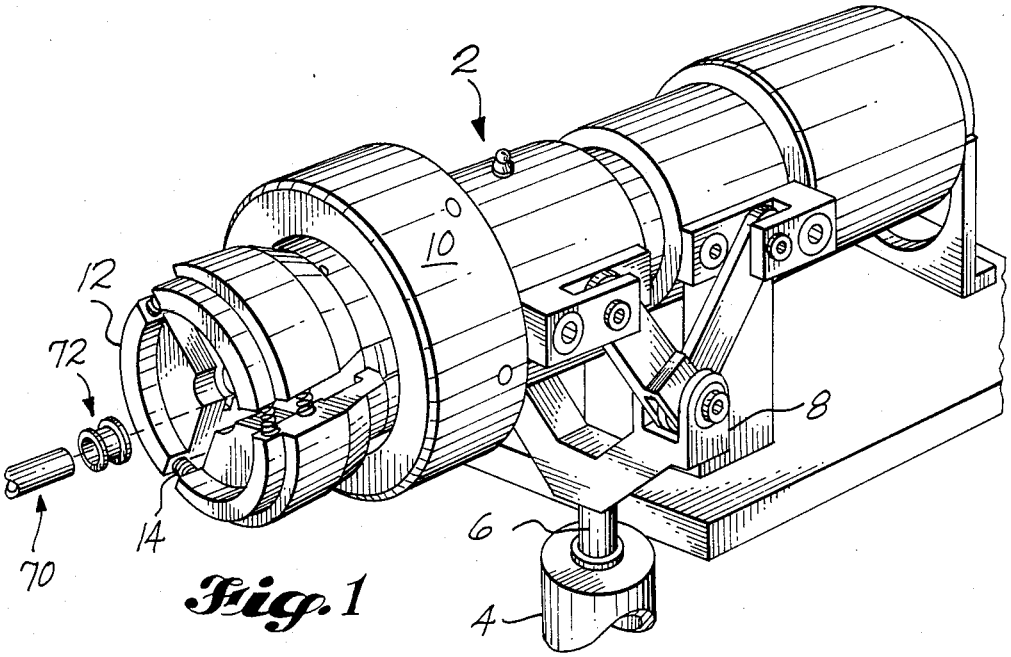
Fig. 1
Fig. 2
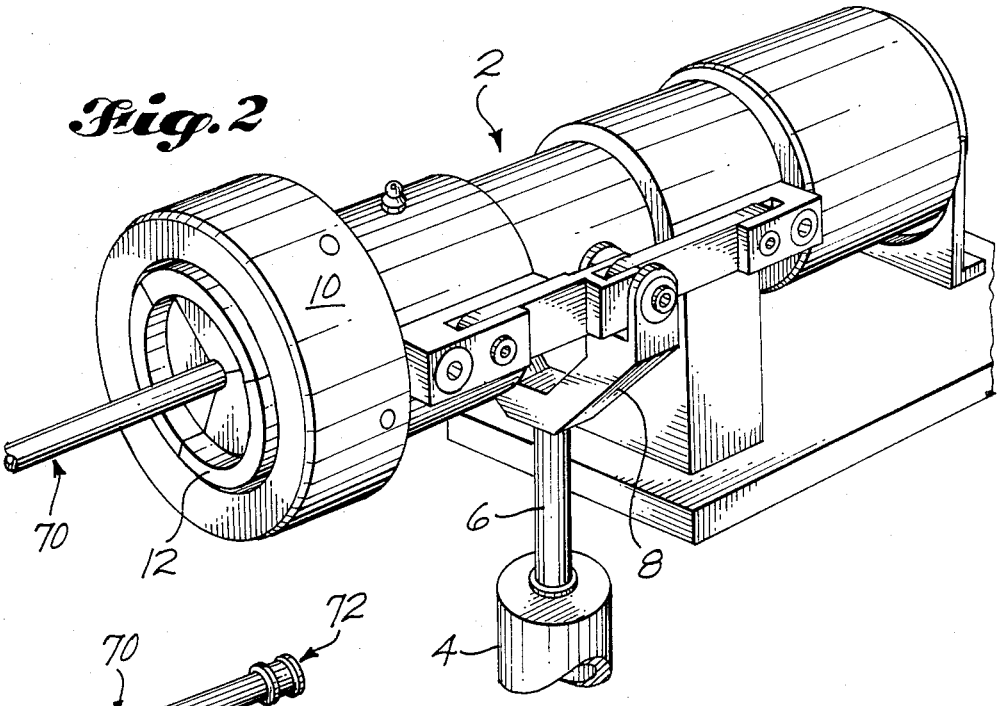
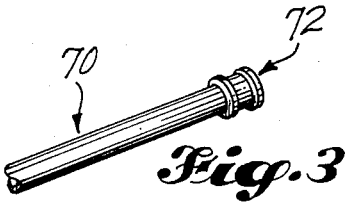
Fig. 3

12
13
14
16
20
22
24
26
28
30
36
38
40
42
44
48
50
51
52
54
56
58
62
64
66
68

TOOLING FOR ELASTOMERIC SWAGING MACHINE

TECHNICAL FIELD

This invention relates to tooling for use in elastomeric swaging machines and, more particularly, to the combination of a split die having a removable and interchangeable split die insert and an anvil having a removable anvil insert that includes bearing means through which the shaft of a drawbolt slides and a radial surface for abutting one end of an elastomeric expander, which bearing means and radial surface contain the elastomeric expander and prevent it from extruding along the drawbolt.

BACKGROUND ART

In an aircraft, there are a number of systems that include sections of metal tubing that are attached to the grooved inner circumferential surfaces of metal ferrules or connectors. These systems include hydraulic, fuel, and electrical systems, each of which requires conduits, portions of which are formed by metal tubing attached to ferrules. For each type of system, the standard method for attaching a tube to a ferrule is to carry out a swaging operation which forces the material of the tube against the inner surface of the ferrule and into the circumferential grooves to provide a secure attachment. For the type of attachment in which one end of the tube abuts against an internal radial shoulder inside the ferrule and the other end of the tube extends out of the ferrule, the attaching of the tube to the ferrule is conventionally carried out by a roller swaging operation. For the type of attachment in which both ends of the tube extend out of the ferrule, the conventional attaching procedure is an elastomeric swaging operation in which an elastomeric sleeve is confined longitudinally and compressed to expand radially to force the tube material into the grooves.

Each type of swaging operation has its limitations. Roller swaging operations result in a smooth inner circumferential surface formed by the tube material. Since there are no grooves on the surface, there is no means of measuring the degree of penetration of the tube material into the grooves on the ferrule without destroying the component formed by the tube and ferrule. In order to test the degree of penetration and thus the security of the attachment, it has been necessary to select a relatively small number of components and cut them into sections so that the degree of penetration can be observed. Roller swaging operations also take a relatively long time to carry out and sometimes cause undesirable elongation of the tubing material.

Elastomeric swaging is relatively quick and avoids the problems of material elongation and the need for destructive testing. However, known machines for elastomeric swaging and the known tooling for such machines are not designed to accommodate the type of attachment in which the tube abuts against a radial shoulder in the ferrule. A major problem that must be solved in order to adapt known machines to this type of attachment is the lack of any means for containing the elastomeric sleeve and preventing it from extruding along the drawbolt. Another problem encountered in using existing elastomeric swaging machines for swaging a number of additional types of ferrules is the high cost of the tooling required. In known machines, the entire split die must be changed for each different type of ferrule, and the die is a relatively large and expensive part of the machine.

The anvil is also a relatively large and expensive part of known elastomeric swaging machines. In the past, it has been necessary to replace the entire anvil when the portion of the anvil through which the drawbolt extends becomes worn. Generally, the other portions of the anvil have a considerably longer life than the portion through which the drawbolt extends. Thus, replacing the entire anvil because this one portion is worn is somewhat wasteful and unreasonably expensive. The present applicants conceived that, if the portion that wears first were made as a separate insert, such portion could be replaced separately without replacing the entire anvil and considerable expense could thereby be saved. The applicants have used an anvil with a replaceable anvil insert in elastomeric swaging machines since about 1980.

Apparatus for carrying out roller swaging or a similar operation is disclosed in U.S. Pat. No. 2,754,577, granted July 17, 1956, to C. A. Maxwell; No. 3,311,971, granted Apr. 4, 1967, to H. E. Hicks et al.; No. 3,683,658, granted Aug. 15, 1972, to R. C. Roeschlaub; No. 3,967,840, granted July 6, 1976, to R. A. McFall; and No. 4,411,456, granted Oct. 25, 1983, to C. F. Martin. The swaging of tube material into internal grooves or recesses is disclosed by Maxwell, McFall, and Martin. U.S. Pat. No. 3,595,047, granted July 27, 1971, to W. K. Fanning discloses an elastomeric forming operation in which O-ring grooves are formed in a tube by exerting axial pressure on an elastomeric member to cause it to expand radially and thereby force the tube material against a grooved die surface. One end of the elastomeric tube abuts the head of the drawbolt which exerts pressure on such member, and the other is received into a recess in an anvil which is referred to as a "collar".

Apparatus for forming material in which the material is held between a relatively rigid surface and a wheel having an elastomeric outer portion that at least partially surrounds the material is shown in U.S. Pat. No. 2,397,608, granted Apr. 2, 1946, to C. M. Johnson; No. 2,454,282, granted Nov. 23, 1948, to H. L. Johnson; No. 2,799,317, granted July 16, 1957, to H. A. Toulmin, Jr.; and No. 3,279,234, granted Oct. 18, 1966, to L. C. Ames. Apparatus for feeding material which has feed wheel portions that yield to accommodate varying thicknesses of the material is disclosed in U.S. Pat. No. 1,946,797, granted Feb. 13, 1934, to F. D. Kinney; No. 2,446,211, granted Aug. 3, 1948, to L. D. Clark; No. 2,803,126, granted Aug. 20, 1957, to J. A. Meyer; No. 2,804,968, granted Sept. 3, 1957, to H. A. Elliott et al.; No. 2,953,291, granted Sept. 20, 1960, to W. F. Huck; No. 3,438,231, granted Apr. 15, 1969, to E. W. Petzschke; No. 4,398,328, granted Aug. 16, 1983, to H. Takenaka et al.; and No. 4,460,433, granted July 17, 1984, to W. K. Boyd. U.S. Pat. No. 3,190,094, granted June 22, 1965, to F. J. Kutas discloses apparatus for splitting a metal drum which includes rubber tires that apparently urge the drum against a "parting" tool.

The above patents and the prior art that is discussed and/or cited therein and the other known apparatus discussed above should be carefully considered for the purpose of putting the present invention into proper perspective relative to the prior art.

DISCLOSURE OF THE INVENTION

The subject of this invention is tooling for use in a swaging machine of the type including a drawbolt and a tubular elastomeric expander, which drawbolt has an axial shaft and a radial pressure surface, and which expander is received onto the shaft of the drawbolt and positioned to be compressed by the pressure surface on the drawbolt when the drawbolt is pulled axially. The tooling is for use in attaching a tube to an inner surface of a ferrule, which inner surface has circumferential grooves thereon and terminates in a radial shoulder which one end of the tube abuts against. According to an aspect of the invention, the tooling comprises the combination of die means and anvil means. The die means includes a main split die body, a split die insert, and means for releasably securing the die insert in the body. The die insert has an interior cavity shaped to closely receive a particular type of ferrule. The anvil means abuts radial surface portions of the die insert and has an axial opening through which the shaft of the drawbolt extends. The anvil means includes a main body portion with an insert cavity surrounding said opening, and a removable anvil insert closely receivable into the insert cavity. The anvil insert has fixed means for containing the elastomeric expander and preventing the expander from extruding along the drawbolt. This means for containing includes bearing means through which the shaft of the drawbolt slides and a radial abutting surface at one end of the bearing means that abuts the radial end of the elastomeric expander opposite the pressure surface on the drawbolt.

The preferred embodiment of the means for containing for use with relatively small elastomeric expanders includes a boss on the anvil insert that terminates in said radial abutting surface and is dimensioned to be received into the ferrule. This type of containing means may be used with a wide range of sizes of elastomeric expanders, including relatively large expanders. Another preferred embodiment of the means for containing comprises a plastic sleeve that surrounds the axial opening in the anvil means and terminates in said radial abutting surface. In this embodiment, the abutting surface is dimensioned to abut the radial end of the expander opposite the pressure surface on the drawbolt and adjacent radial end portions of the ferrule. This embodiment of the containing means has the advantages of being relatively simple and inexpensive. However, the embodiment with the boss that extends into the ferrule is preferred for relatively thin expanders because it is more effective in containing such expanders.

The apparatus of the invention solves the problems discussed above in connection with conventional methods for swaging metal tubing to ferrules. Since the apparatus is used in an elastomeric swaging operation, the disadvantages of roller swaging are avoided. The proper full penetration of the tubing material into the grooves in the ferrule can easily be measured by measuring the distance between diametrically opposite valley portions of the grooves after the swaging process. This can be accomplished without destroying or damaging the component. The apparatus of the invention also makes it possible to use known elastomeric swaging machines in order to swage metal tubes to ferrules of the type having an internal radial shoulder against which the tube abuts. The apparatus of the invention solves the problem of providing means for containing the elastomeric expander and preventing it from extruding along the drawbolt.

These and other advantages and features will become apparent from the detailed description of the best modes for carrying out the invention that follows.

BRIEF DESCRIPTION OF THE DRAWINGS

In the drawings, like element designations refer to like parts throughout, and:

FIG. 1 is a pictorial view of an elastomeric swaging machine into which the first preferred embodiment of the apparatus of the invention has been incorporated, showing the machine with the split die in an open position ready to receive a ferrule and tube.

FIG. 2 is like FIG. 1 except that it shows the die in a closed position and the tube extending outwardly from the die.

FIG. 3 is a pictorial view of a representative tube and ferrule attachment which may advantageously be made by use of the apparatus of the invention.

BEST MODES FOR CARRYING OUT THE INVENTION

The drawings show tooling that is constructed according to the invention and that also constitutes the best modes of the invention currently known to the applicant. FIGS. 1 and 2 illustrate a particular type of elastomeric swaging machine 2 into which the tooling of the invention may be advantageously incorporated. It is anticipated that the primary use of the tooling of the invention will be in elastomeric swaging machines of the type shown in FIGS. 1 and 2. However, it is of course to be understood that the tooling of the invention may also be used to advantage in other types of elastomeric swaging apparatus.

Figure 4:
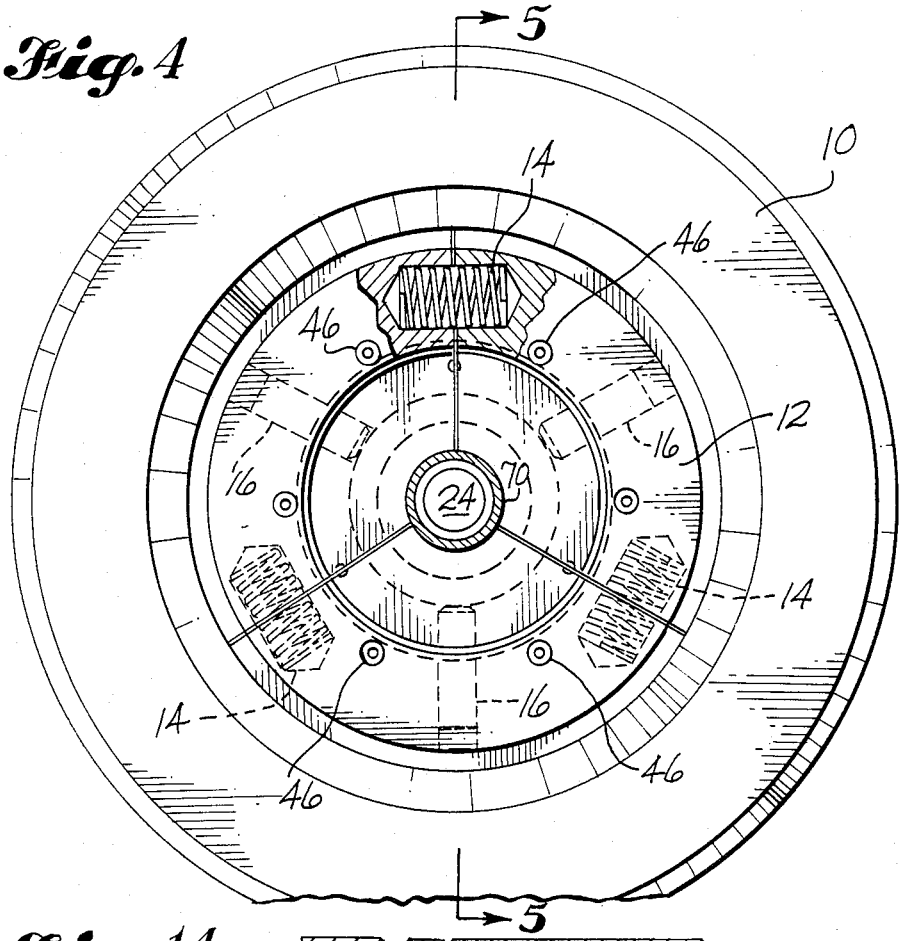
FIG. 4 is a front elevational view of the machine and tooling shown in FIG. 2.
Figure 5:
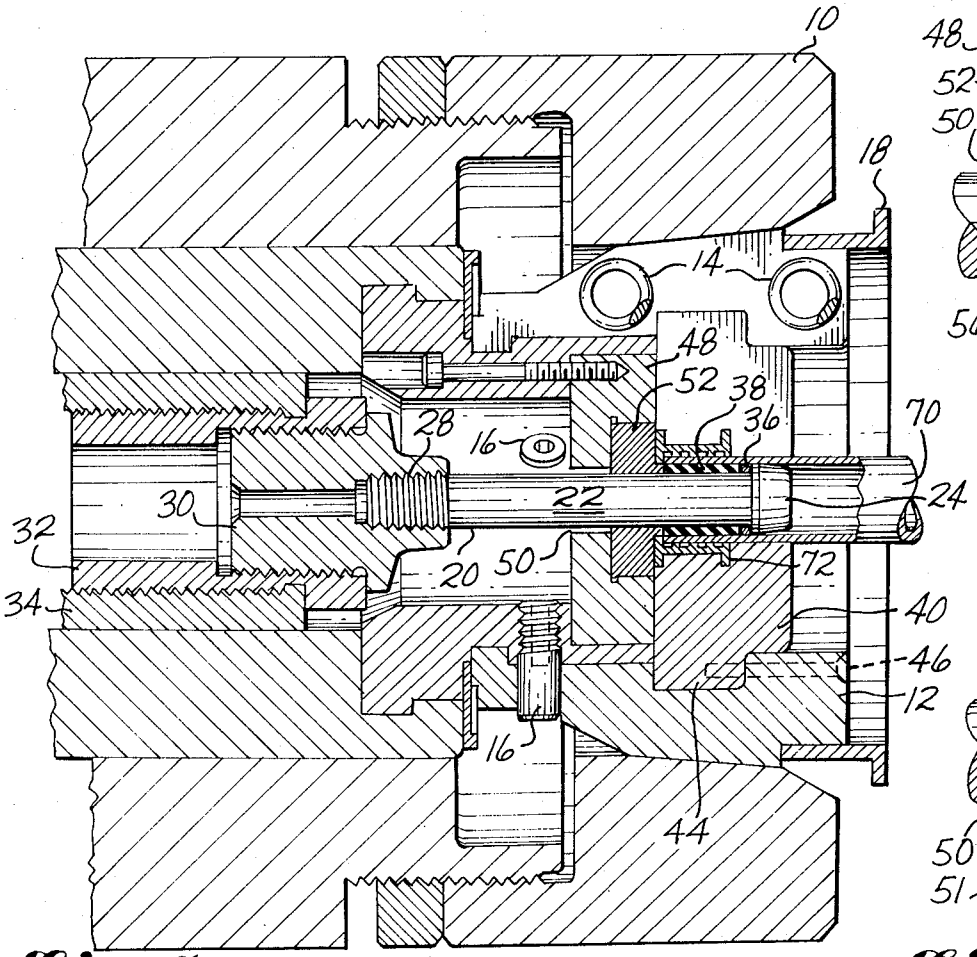
FIG. 5 is a sectional view taken along the line 5—5 in FIG. 4.
Figure 8:
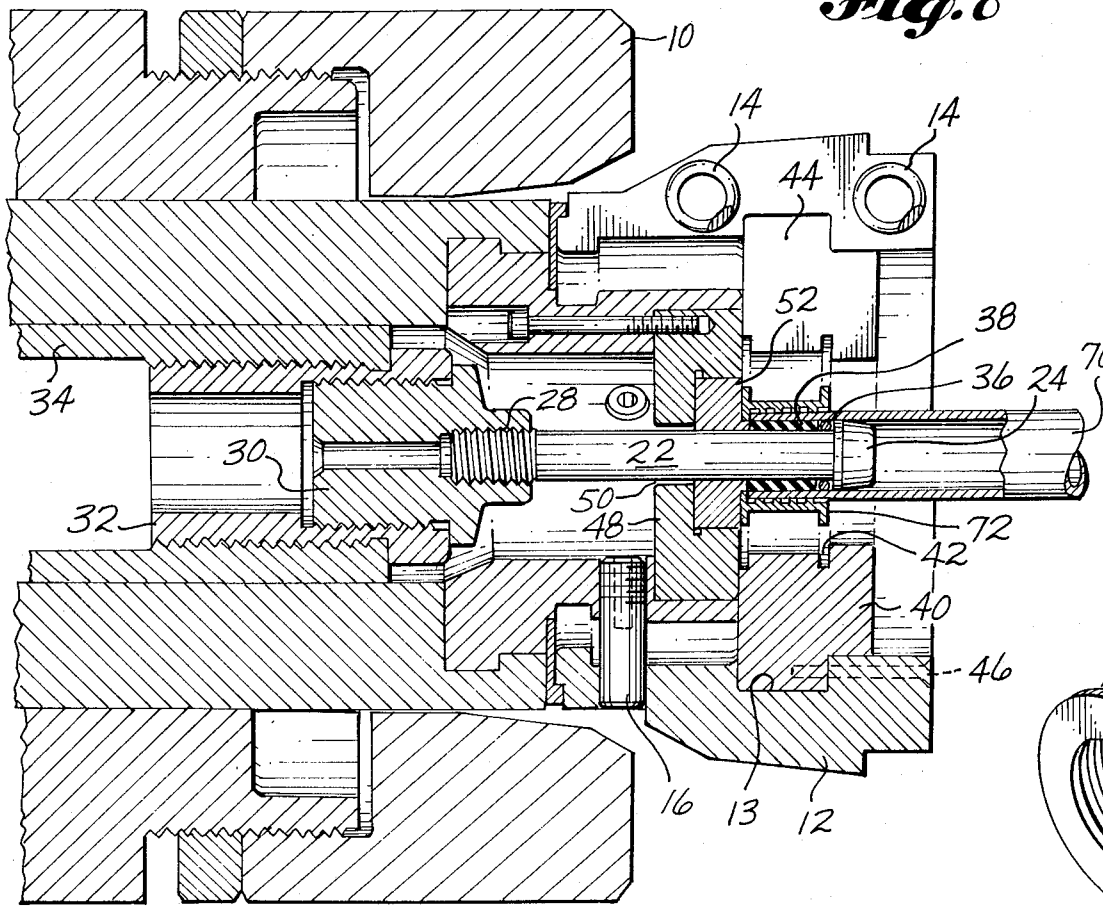
FIG. 8 is like FIG. 5 except that it shows the die in an open position.

The machine 2 shown in FIGS. 1 and 2 is of the type manufactured by the Sierracin/Harrison Company of Burbank, Calif. and designated by Model Nos. 5570 and 5580, which differ primarily in size. The machine 2 has a split die 12 that is biased into an open position by springs 14. When the machine 2 is operated, a collar 10 moves axially forwardly around the die 12 to force the three segments of the die 12 together into a closed position, as shown in FIG. 2. The power for operating machine 2 is provided by a hydraulic cylinder 4 and piston 6. Linkage 8 connects thee collar 10 and the piston 6 and translates the vertical reciprocating motion of the piston 6 into horizontal axial sliding movement of the collar 10. Referring to FIGS. 4 and 5, sliding pin connections 16 are provided to allow the segments of the split die 12 to move between their open and closed positions. FIG. 5 also shows a retaining ring 18 that would ordinarly be provided for safe operation of the machine 2. A retainer plate (not shown) of a known type is also generally required.

Figure 14:
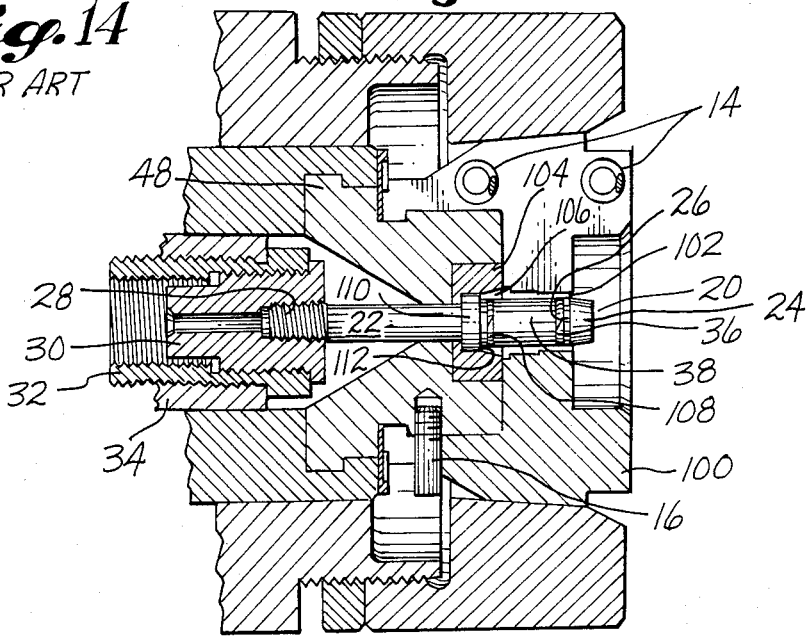
Fig. 14 PRIOR ART
FIG. 14 is like FIG. 5 except that it shows the tooling that was used with the machine shown in FIGS. 1 and 2 prior to the present invention.

FIG. 14 is a sectional view of the machine shown in FIGS. 1 and 2 with the tooling that was used prior to the present invention and that is still in use to form attachments between a ferrule and a piece of metal tubing in which both ends of the tubing extend outwardly from the ferrule. The tooling includes a drawbolt 20 which has an axial shaft 22 and a head 24 which forms a radial pressure surface 26. The drawbolt 20 is attached to the ram 34 of the machine 2 for axial reciprocation. The shaft 22 of the drawbolt 20 has a threaded end 28 which is secured to the ram 34 by means of a two-piece adapter 30, 32. The adapter 30, 32 is interchangeable with a number of similar adapters, each of which accommodates a different size drawbolt.

The die 100 shown in FIG. 14 is formed by a split die body 100 which has a cavity 102 for receiving a ferrule. There is no die insert, and therefore, the entire die body 100 must be changed to accommodate a different type of ferrule. The tooling shown in FIG. 14 includes an anvil 48 that has an anvil insert 104. A tubular elastomeric expander 38 is received onto the shaft 22 of the drawbolt 20. Two split rings 36, 108 are provided, one at each axial end of the expander 38, to prevent the expander 38 from extending along the drawbolt 20. A bushing 110 is also received onto the shaft 22. The bushing 110 provides a radial abutment or indexing surface 112 for the inner end of the tube being attached to the ferrule. A cavity 106 is formed in the anvil insert 104 to accommodate the bushing 110 and the end of the tube. In FIG. 14, neither the ferrule nor the tube is shown.

Referring to FIGS. 4, 5, 8, and 10, in the tooling of the present invention the die body 100 is replaced by a main split die body 12 and a split die insert 40. The insert 40 is received into a cavity 13 in the die body 12 and is releasably secured therein by means of set screws 46. The screws 46 prevent the insert 40 from separating from the main die body 12 when the die body 12 is in its open position shown in FIGS. 1 and 8. Each of the three segments of the insert 40 is secured to a corresponding segment of the die body 12 and opens therewith to receive a tube and ferrule. An enlarged diameter portion 44 of the insert 40 projects into a recess in the cavity 13 in the body 12 to further secure the insert 40 in position when the die body 12 and insert 40 are in their closed positions shown in FIGS. 4 and 5. The insert 40 has an interior cavity 42 shaped to closely receive a given type of ferrule.

Referring to FIGS. 5–8, the tooling of the invention includes an anvil 48, 52 that abuts radial surface portions of the die insert 40. The anvil 48, 52 has an axial opening 50 through which the shaft 22 of the drawbolt 20 extends. The anvil includes a main body portion 48 and an insert 52. A cavity 51 is formed in the main body 48 for receiving the anvil insert 52. The cavity 51 and the anvil insert 52 surround the axial opening 50. The insert 52 is slip fit into the cavity 51, with a tolerance in the order of 0.001 inch. The fit is tight enough to keep the insert 52 in position during use, but loose enough to allow the insert 52 to be removed and replaced.

In tooling constructed according to the invention, the anvil insert 52, 52' has fixed means for containing the elastomeric expander 38 and preventing the expander 38 from extruding along the shaft 22 of the drawbolt 20. This fixed means contains the expander 38 at its inner end adjacent to the anvil. The fixed containing means of the invention performs the same function as the second split ring 108 of the prior tooling shown in FIG. 14, which ring 108 is received inside the tube being attached. In both the prior tooling and the tooling the invention, a first split ring 36 is positioned between the outer end of the expander 38 and the head 24 of the drawbolt 20 to contain the outer end of the expander 38. When the drawbolt 20 moves axially to compress the expander 38, the split ring 36 distorts and acts as a seal to prevent extrusion of the expander 38.

Figure 9:
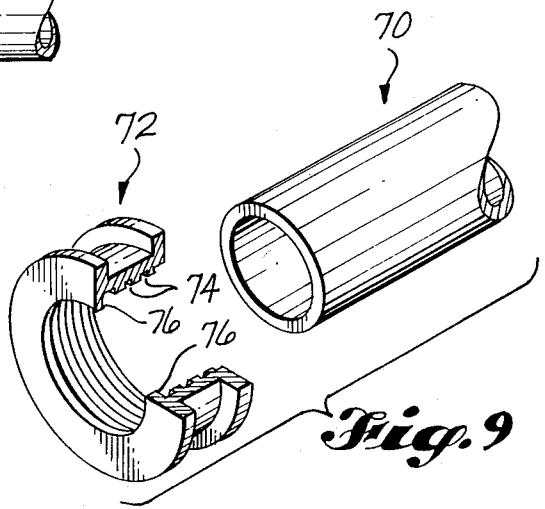
FIG. 9 is an enlarged pictorial view of a tube end portion and a ferrule to which it may be attached, with portions of the ferrule cut away to illustrate its inner surface.

As noted above, the tooling of the present invention is designed for use in attaching a tube 70 to an inner circumferential surface of a ferrule 72, 72', which inner surface has circumferential grooves 74 thereon and terminates in a radial shoulder 76. See FIG. 9. The inner end of the tube 70 abuts against or indexes on the shoulder 76. See FIGS. 5–8, 12 and 13. For this type of tube/-ferrule attachment, the two split ring/bushing arrangement of the prior tooling cannot be used. The tooling of the present invention replaces such arrangement with the fixed means for containing the expander 38 described above.

The fixed means for containing the expander 38 of the present invention includes bearing means through which the shaft 22 of the drawbolt 20 slides, and a radial abutting surface at one end of the bearing means. This radial abutting surface abuts the inner radial end of the expander 38; i.e. the end opposite the head 24 of the drawbolt 20. FIGS. 5–8 and 10 illustrate the first preferred embodiment of the fixed containing means. In this embodiment, the anvil insert 52 has a boss 54 formed integrally thereon. The boss 54 terminates in a radial abutting surface 58 for abutting the inner end of the expander 38. The boss 54 is dimensioned to be received into the ferrule 72 as shown in the drawings. The axial opening through the insert 52 has a machined bearing surface 56 for slidingly engaging the shaft 22 of the drawbolt 20. The tolerance between the shaft 22 and the bearing surface 56 is very close to prevent extrusion of the expander 38.

Figures 10, 11:
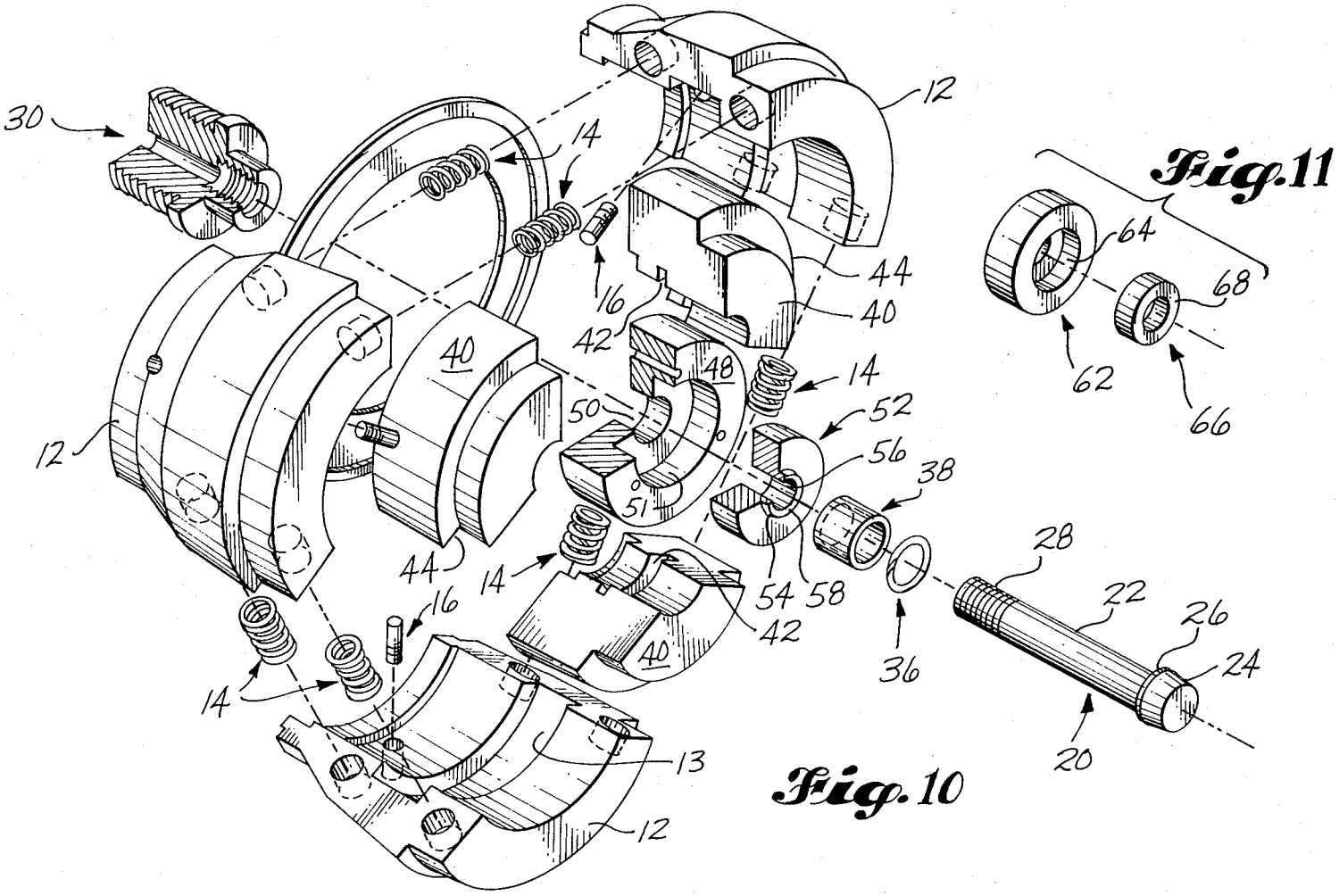
FIG. 10 is an exploded pictorial view of the tooling shown in FIGS. 4–8.
FIG. 11 is a pictorial view of the second preferred embodiment of the anvil insert.
Figure 12:
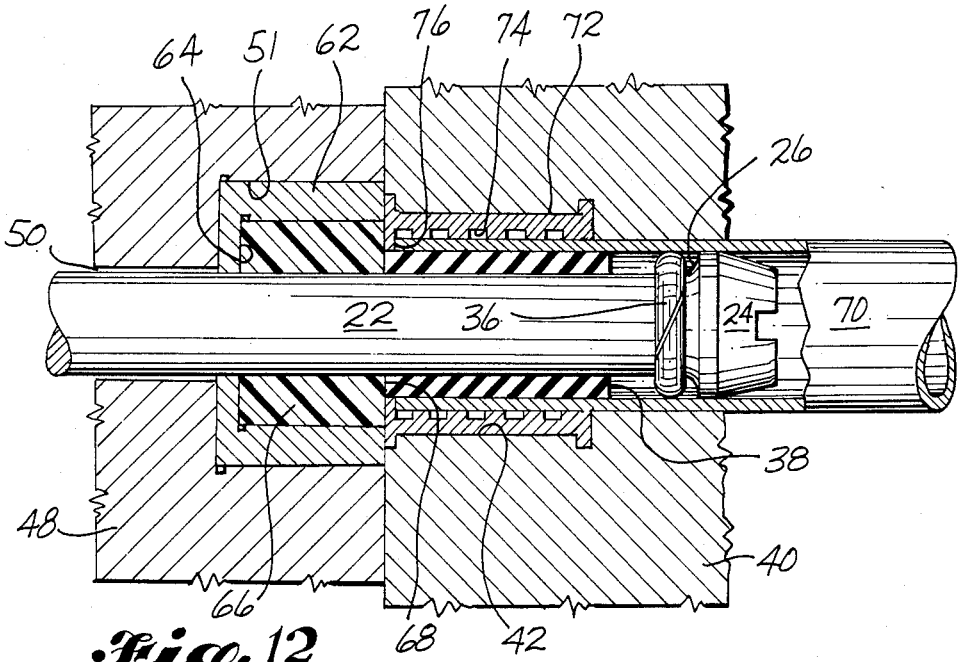
FIG. 12 is like FIG. 6 except that it shows the second preferred embodiment of the anvil insert.

The second preferred embodiment of the fixed containing means is shown in FIGS. 11 and 12. In this embodiment, the anvil insert 62 has a cavity 64 rather than a boss. A plastic sleeve 66 is received into this cavity 64. The sleeve 66 terminates in a radial abutting surface 68 which is dimensioned to abut the inner radial end of the expander 38 and adjacent radial end portions of the ferrule 72. The sleeve 66 is press fit into the cavity 64 to secure it therein. The sleeve 66 is dimensioned to extend from the radial surface of the insert 62 a very small amount, in the order of 0.001 inch. The sleeve 66 is made from a plastic material that is sufficiently rigid to maintain the configuration of the sleeve 66 but that has sufficient flexibility to ensure a tight sealing fit between the sleeve 66 and the end of the ferrule 72. An example of a suitable material for the sleeve 66 is a polyurethane having a shore hardness of 70D.

Figure 13:
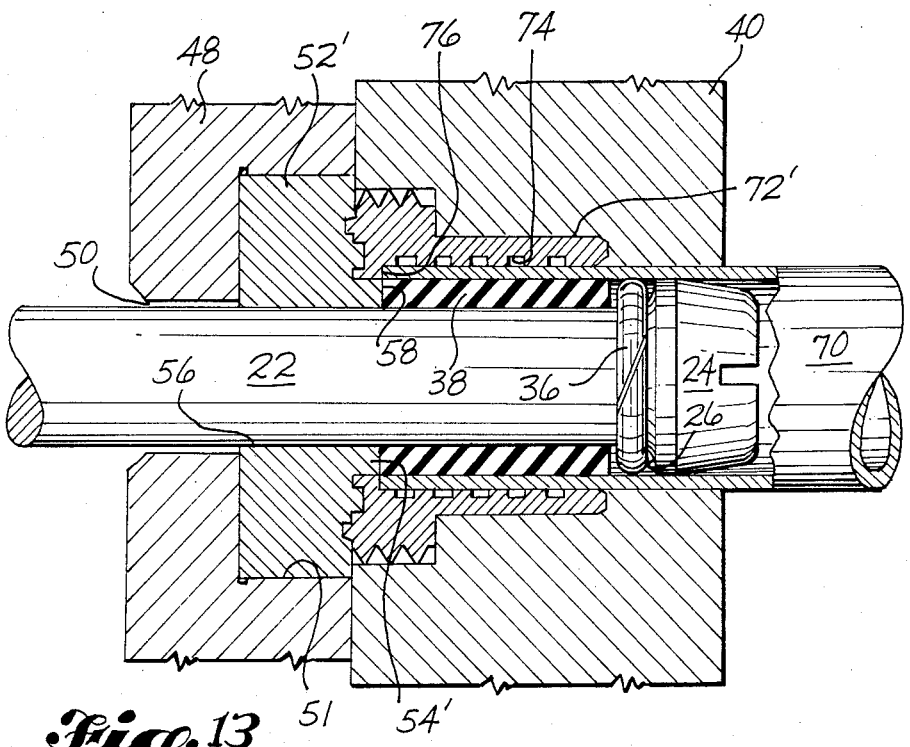
FIG. 13 is like FIG. 6 except that it shows an anvil insert with a different configuration to fit a different type of ferrule.

FIG. 13 illustrates another form of the first preferred embodiment of the anvil insert. The anvil insert 52' shown in FIG. 13 differs from the insert 52 shown in FIGS. 5–8 and 10 primarily in the configuration of its boss 54' which is formed to mesh with the non-flat end of a different type of ferrule 72'.

Figure 6:
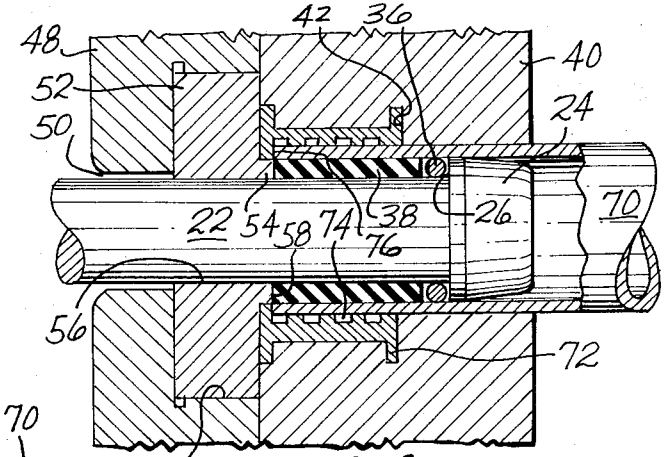
FIG. 6 is an enlarged fragmentary view of a portion of FIG. 5.
Figure 7:
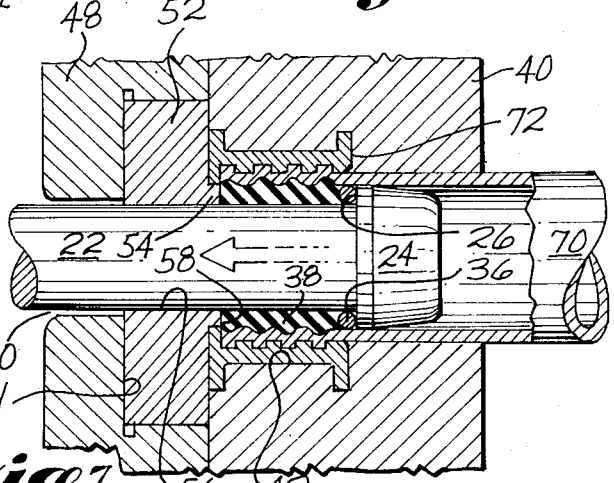
FIG. 7 is like FIG. 6 except that it shows the drawbolt being pulled axially to compress the elastomeric expander and swage the tube to the inside of the ferrule.

The operation of the tooling of the invention is illustrated in FIGS. 6 and 7. FIG. 6 shows the ferrule 72 and tube 70 in place in the closed die insert 40. FIG. 7 illustrates the drawbolt 20 being pulled axially by the ram 34 to cause the pressure surface 26 on the drawbolt 20 to compress the expander 38. The expander 38 is compressed between the boss 54 on the anvil insert 52 and the split ring 36. The boss 54 and ring 36 confine the expander 38 and prevent any axial extrusion. Therefore, as the expander 38 is compressed, the only direction it can move in is a radial direction. The material of expander 38 expands radially to force the tube material 70 against the inner surface of the ferrule 72 and into the grooves 74. As can be seen in FIG. 7, the tubing material 70 takes on the grooved configuration of the ferrule 72.

The tooling of the invention may be used to swage a variety of materials, but the primary use for the tooling is anticipated to be in swaging aluminum alloy tubing to aluminum alloy ferrules. The elastomeric expander may be made from various materials, such as urethane. Examples of suitable materials are the material sold by Rezolin, Inc., of Chatsworth, Calif., under the name Rezolin 3121S and the material sold by the Upjohn Company under the name CPR Pellethane 2103-90A. Machines of the type shown in FIGS. 1 and 2 generally accommodate tube diameter sizes ranging from about ⅜ inch to 2½ inches, and provide working pressures of about 130 psi to about 650 psi.

It will be obvious to those skilled in the art to which this invention is addressed that the invention may be used to advantage in a variety of situations. Therefore, it is also to be understood by those skilled in the art that various changes, modifications, and omissions in form and detail made be made without departing from the spirit and scope of the invention as defined by the following claims.

What is claimed is:

1. A swaging machine comprising:

a drawbolt having an axial shaft and a radial pressure surface;

a tubular elastomeric expander received onto the shaft and positioned to be compressed by the pressure surface when the drawbolt is pulled axially; and tooling for use in attaching a tube to an inner surface of a ferrule, said inner surface having circumferential grooves thereon and terminating in a radial shoulder which one end of the tube abuts against, said tooling comprising the combination of:

die means including a main split die body surrounding said draw bolt and radially moveable towards said draw bolt, a split die insert having an interior cavity shaped to closely receive a particular type of ferrule, and means for releasably securing the die insert in said body; and anvil means abutting radial surface portions of the die insert and having an axial opening through which the shaft of the drawbolt extends; said anvil means including a main body portion having an insert cavity surrounding said opening, and a removable anvil insert closely receivable into said insert cavity and having fixed means for containing the elastomeric expander and preventing said expander from extruding along the drawbolt; said anvil insert abutting radial surface portions of a ferrule received in the interior cavity of the die insert; said means for containing including bearing means through which the shaft of the drawbolt slides and a radial abutting surface at one end of the bearing means that abuts the radial end of said expander opposite said pressure surface on the drawbolt; said means for containing being fixed relative to the die means when the drawbolt is pulled axially to compress the elastomeric expander; and said means for containing including a boss on the anvil insert that terminates in said radial abutting surface, that has an outer circumferential surface extending axially from said radial abutting surface, and that is dimensioned to be received into said ferrule with said outer circumferential surface adjacent to an inner circumferential surface of said ferrule.

2. A swaging machine comprising:

a drawbolt having an axial shaft and a radial pressure surface;

a tubular elastomeric expander received onto the shaft and positioned to be compressed by the pressure surface when the drawbolt is pulled axially; and tooling for use in attaching a tube to an inner surface of a ferrule, said inner surface having circumferential grooves thereon and terminating in a radial shoulder which one end of the tube abuts against, said tooling comprising the combination of:

die means including a main split die body surrounding said draw bolt and radially moveable towards said draw bolt, a split die insert having an interior cavity shaped to closely receive a particular type of ferrule, and means for releasably securing the die insert in said body; and anvil means abutting radial surface portions of the die insert and having an axial opening through which the shaft of the drawbolt extends; said anvil means including a main body portion having an insert cavity surrounding said opening, and a removable anvil insert closely receivable into said insert cavity and having fixed means for containing the elastomeric expander and preventing said expander from extruding along the drawbolt; said anvil insert abutting radial surface portions of a ferrule received in the interior cavity of the die insert; said means for containing including bearing means through which the shaft of the drawbolt slides and a radial abutting surface at one end of the bearing means that abuts the radial end of said expander opposite said pressure surface on the drawbolt; said means for containing being fixed relative to the die means when the drawbolt is pulled axially to compress the elastomeric expander; and said means for containing comprising a sleeve surrounding said opening and terminating in said radial abutting surface, said abutting surface being dimensioned to abut said radial end of said expander and adjacent radial end portions of the ferrule, and said sleeve being made from a plastic material that is sufficiently rigid to maintain a constant configuration but has sufficient flexibility to ensure a tight sealing fit between said sleeve and said adjacent radial end portions.

* * * * *

UNITED STATES PATENT AND TRADEMARK OFFICE

CERTIFICATE OF CORRECTION

PATENT NO. : 4,641,407

DATED : February 10, 1987

INVENTOR(S) : Gerald G. Blevins et al.

It is certified that error appears in the above-identified patent and that said Letters Patent are hereby corrected as shown below:

Column 5, line 38, "extending" should be -- extruding --.

Column 6, line 29, "arragement" should be -- arrangement --.

Claim 1, column 7, line 58, "draw bolt" should be -- drawbolt --.

Claim 1, column 7, line 59, "draw bolt" should be -- drawbolt --.

Claim 2, column 8, line 34, "draw bolt" should be -- drawbolt --.

Claim 2, column 8, line 35, "draw bolt" should be -- drawbolt --.

Signed and Sealed this

Twenty-fifth Day of August, 1987

*Attest:*

DONALD J. QUIGG

*Attesting Officer*

*Commissioner of Patents and Trademarks*